United States Patent [19]

Webster

[11] 4,228,599

[45] Oct. 21, 1980

[54] METHOD FOR RECORDING THE WALKING ABILITY OF AN INDIVIDUAL

[76] Inventor: David F. Webster, 1325A Edwards Ave., Santa Rosa, Calif. 95401

[21] Appl. No.: 946,769

[22] Filed: Sep. 28, 1978

Related U.S. Application Data

[60] Division of Ser. No. 862,093, Dec. 19, 1977, which is a continuation-in-part of Ser. No. 773,683, Mar. 22, 1977, abandoned.

[51] Int. Cl.[2] ..... B41L 1/00

[52] U.S. Cl. ..... 35/29 R; 282/1 B

[58] Field of Search ..... 35/29 R, 29 A, 29 B, 35/29 C, 29 D, 29 E, 29 F; 282/1 B

[56] References Cited

U.S. PATENT DOCUMENTS

| | | | |
|---|---|---|---|
| 1,543,747 | 6/1925 | Brey | 282/1 B |
| 2,998,983 | 9/1961 | Digate | 282/1 B |
| 3,016,812 | 1/1962 | Chatlain | 35/29 F X |
| 3,223,437 | 12/1965 | Bertsch | 282/11.5 A |

OTHER PUBLICATIONS

"Ski Aid", Parade Section of Washington Post, p. 19, Mar. 12, 1967.

"All-Purpose Broad/Long Jump Mat", p. 15 of Cleo Catalog, Feb. 1976.

*Primary Examiner*—Harland S. Skogquist

*Attorney, Agent, or Firm*—Robert H. Eckhoff

[57] ABSTRACT

A simple form of testing device is provided to record an individual's walking ability under the conditions existing at the time of the test. The individual's walking ability may be open to question because of ill health occasioned by a stroke or because of a suspicion that the individual is under the influence of alcohol or a drug.

4 Claims, 26 Drawing Figures

METHOD FOR RECORDING THE WALKING ABILITY OF AN INDIVIDUAL

This is a division, of application Ser. No. 862,093, filed Dec. 19, 1977 which is a continuation-in-part of Ser. No. 773,683, filed Mar. 22, 1977, now abandoned.

BACKGROUND OF THE INVENTION

The test device and the method of the present invention provide a permanent and irrefutable record of the individual's walking ability as of the time of the test.

SUMMARY OF THE INVENTION

It is in general the broad object of the present invention to provide a simple test device which, when correctly utilized in accordance with the method of this invention, provides a permanent and irrefutable record of the individual's ability to walk a straight line. The footprints of the individual are recorded as a written record which can be suitably exhibited at any later time.

The method and device are based on the broad use of what can be characterized as an endless blank form. These are readily manufactured in a well-known manner. I modify these, however, incorporating a suitable inking element and a print receiving element upon which a footprint is applied when the pressure of a foot is placed upon the inking element to leave a permanent record of just where the foot was placed.

DESCRIPTION OF THE PREFERRED EMBODIMENT

Figure 3:
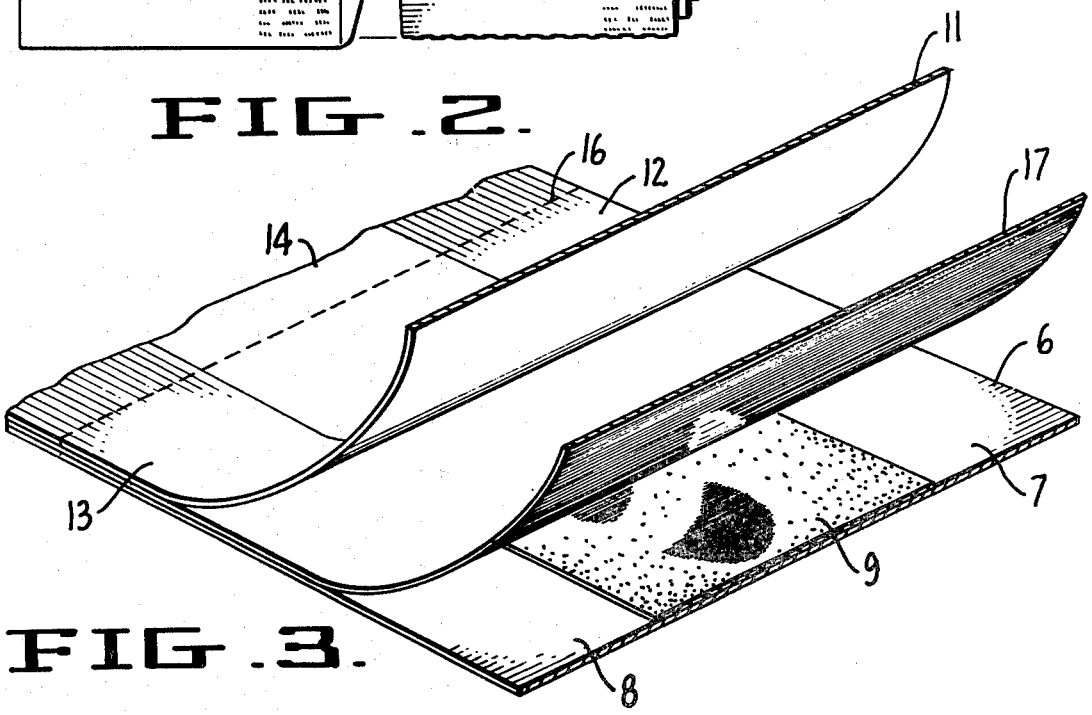
FIG. 3 is another perspective view showing a cross section through the test device.

Referring to the drawings and particularly to FIG. 3, the test device comprises a base sheet 6 having opposite marginal edges 7 and 8 on either side of a central portion 9.

An overlay sheet 11 is provided as the upper or topmost layer. The longitudinal edges 12 and 13 are printed in a distinctive color such as orange or red to provide an intermediate or central portion 14 which is white and provides a longitudinally extending white line. Normally the structure is made up in a plurality of sections, and in FIGS. 1 and 2 I have shown the several sections joined together along the outer edges and having fold lines 16.

Intermediate the uppermost layer 11 and the lowermost layer 6, I provide a sheet of carbon paper 17 or a layer of a non-drying ink. When carbon paper is used, a strip coating of light adhesive is laid on the lower sheet of the same width as the top white strip. The carbon paper imprint will then transfer to the lower layer, leaving a permanent imprint of either fingerprint or footprint.

Figure 4:
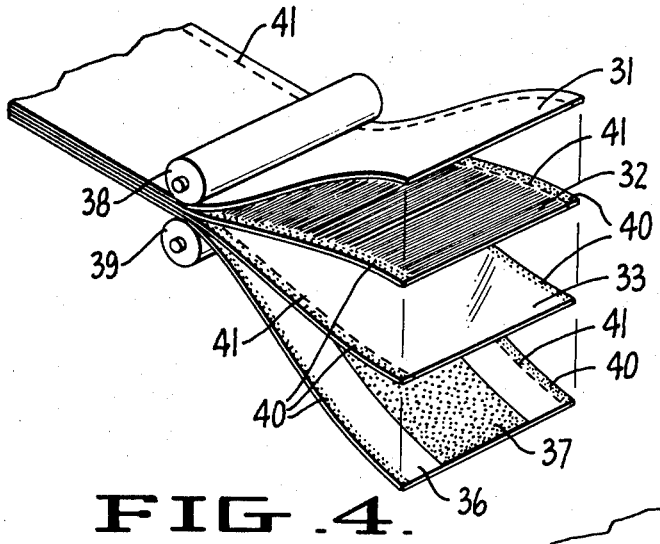
FIGS. 4, 5, 6 and 7 are each perspective views showing various assemblies and structures embodying the present invention.

Referring to FIG. 4, there is shown one embodiment of a composite test device having a multiple layer structure including a topmost or cover sheet 31, a carbon paper insert 32, a silicone coated paper sheet 33 and the bottom sheet 36 having adhesive 37 applied along the length of the strip centrally thereof. The strips are secured at their margins by adhesive 40 and assembled by passage between upper and lower rollers 38 and 39. The various sheets may also have perforations 41 along their margins as shown to facilitate removal of the silicone coated sheet from the multiple layer structure.

In use, one wishing to use the structure to test a suspected offender will grasp the righthand side of the assembled structure along the righthand side, thus releasing the joint provided upon that side of the structure. The will enable the silicone coated paper to be removed. The silicone coated paper prevents transfer from the carbon paper to the base sheet prior to use. After the structure has been used, the opposite side of the sheet is released and the record will appear upon the adhesive treadway 37.

Figure 5:
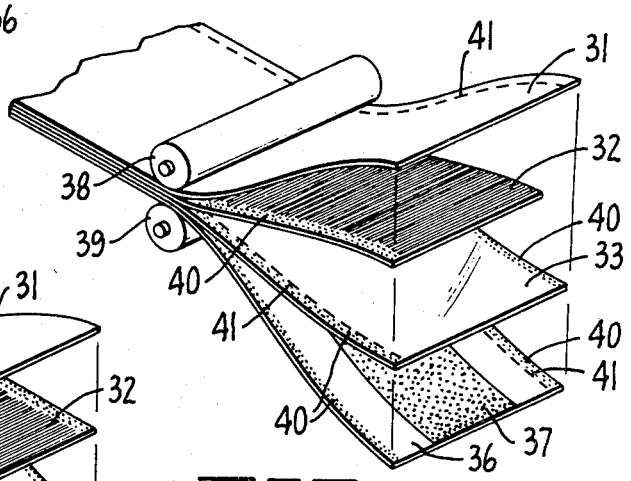

The structure shown in FIG. 5 is much like that shown in FIG. 4, except that the carbon paper does not extend completely across the silicone coated sheet.

Figure 6:
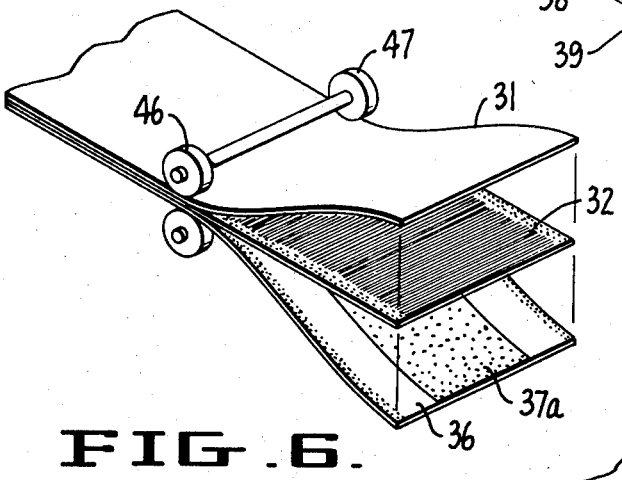

The structure shown in FIG. 6 is like that in FIGS. 4 and 5, except that the silicone coated sheet is not included. However, the pressure rollers comprise only opposite rollers 46 and 47 so that the pressure is applied only on the side edges. The adhesive treadway is provided with a light tack adhesive 37*a* so that the silicone coated paper is not needed.

Figure 7:
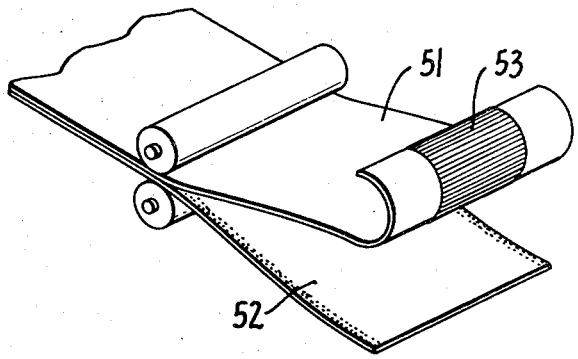

In the structure shown in FIG. 7, the top and bottom sheets 51 and 52 are provided. The underside of sheet 51 has a non-drying ink provided as a strip 53 down the length of the upper sheet 51 so that when the structure is disassembled, the record appears upon the lowermost sheet 52.

Figure 8:
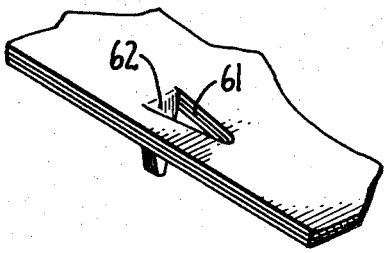
FIG. 8 is a fragmentary perspective view showing one method of procuring several sheets together.

The sheets can be secured together as is shown in FIG. 8 by providing perforations 61 which provide a depending tongue 62 which holds the several sheets together at spaced intervals.

Figure 1:
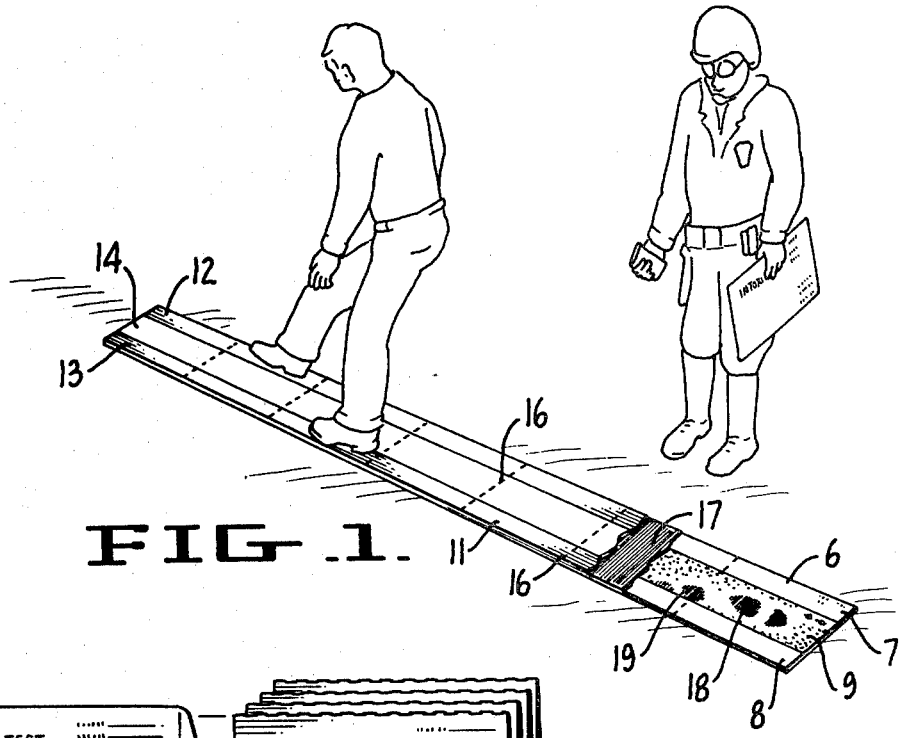
FIG. 1 is a perspective view showing a suspect undergoing a test employing the device of the present invention.
Figure 2:
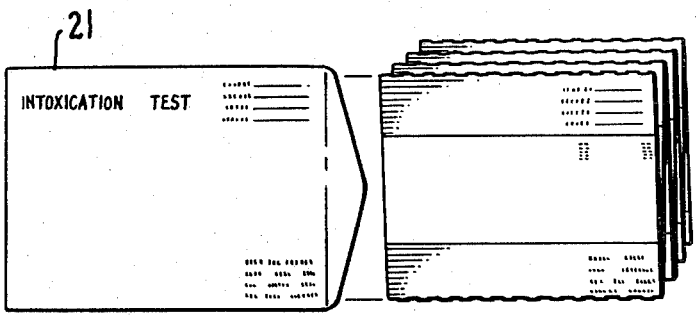
FIG. 2 is a perspective view of the test device in folded form.

In use, the several connected strips are stretched out longitudinally as appears in FIG. 1 and a person undergoing the test is asked to walk heel to toe from one end of the strip to the other. If a person falters during the test or places his foot other than in the white portion, this will be clearly indicated on the bottom sheet 9. Thus, as appears in FIG. 1, the suspect's first footprint indicated at 18 is clearly in the white portion but the next footprint 19 is to one side of the white line so that the entire print is not shown.

When the top sheet 11 is striped away and the carbon paper layer 17 removed, there is a clear record of the test given, leaving nothing to be disputed regarding the motorability of the person tested. The testing device functions equally well on asphalt, concrete or any firm surface.

The impression of prints can either be obtained by using a non-drying ink with a protective coating over the ink to prevent drying or an adhesive process so that the impression is transferred to the adhesive coated section from the carbon paper either by pressure of footprints or fingerprints on the bottom sheet. The material used to provide the top and bottom 6 and 11 are moisture resistant.

After use the assembled sheets are folded and packaged in a suitable envelope or container 21.

In the upper righthand corner of the top sheet suitable information can be entered such as the name of the testee or driver, his driver's license, the date, the location and the officer completing the test. Also, prints from each of the thumbs can be provided upon the face of the envelope or in a suitable space provided on the upper left corner of one of the lower segments of base sheet 6 and marked left and right thumb print on the device used for the heel to toe test. In the lower righthand corner, I provide instructions for use such as the following:

1. Walk from either direction.
2. Testee walks white line heel to toe. Have testee press right and left thumb in area indicated.
3. Do not separate at individual horizontal perforations.
4. Do not inspect for prints.
5. Any step on white line portion is guaranteed to transfer prints to bottom sheet.
6. Refold and return to envelope.
7. Avoid pressure to white line before and after testing to prevent undue additional prints.

Figure 9:
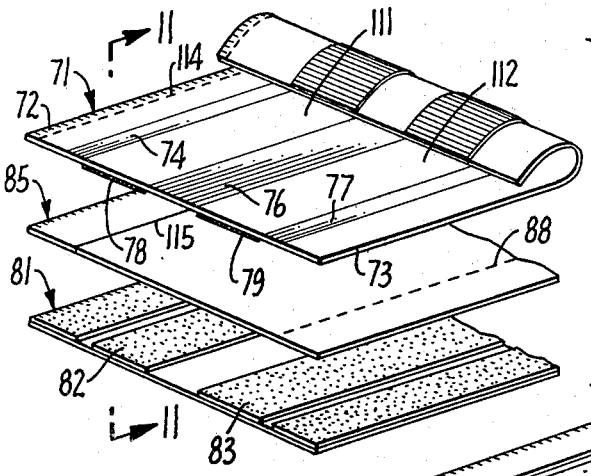
FIG. 9 is an exploded view showing in a superimposed relationship the several elements making up another form of the test device of the present invention.

Referring to FIGS. 9 through 17 and particularly to FIG. 9, the device comprises a top sheet 71 having opposite marginal side edges 72 and 73 to define two wide bands 111 and 112 on the white top sheet. Successively across the face of the upper sheet, I provide colored bands 74, 76 and 77 of a distinctive color such as blue. These colored bands are printed on the white top sheet 71 so that the colored strips 74, 76 and 77 stand out quite prominently to define the wide bands 111 and 112. On the underside of sheet 71 between the colored bands 74, 76 and 77, I provide a material which will leave a print immediately beneath the sheet 71 on sheet 81 as by bands of a carbon paper 78 and 79. Sheet 81 has colored bands corresponding to bands 74, 76 and 77. Above the bottom sheet 81 is a protective sheet 85. Bottom sheet 81 has an adhesive surface 82 thereon extending across the outer margin of the carbon paper areas 78 and 79. The several sheets are secured along one of the marginal edges by rivets or by gluing.

Figure 10:
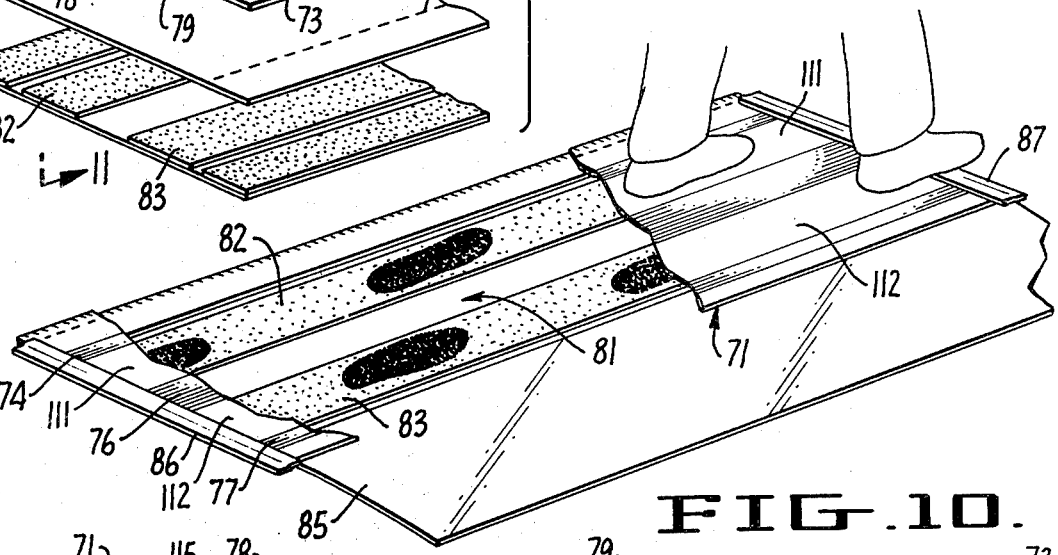
FIG. 10 is a perspective view showing the test device of FIG. 9 in use.
Figure 11:
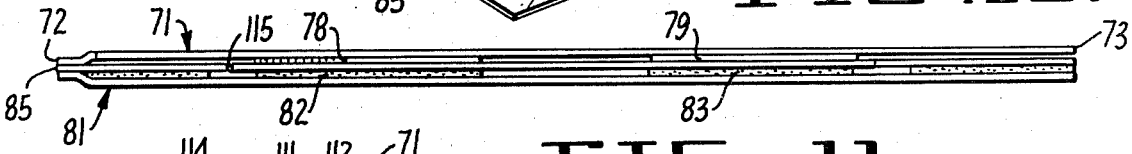
FIG. 11 is a section taken along the line 11—11 in FIG. 9.
Figure 12:
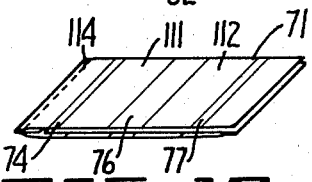
FIG. 12 is a perspective view of the device in assembled form.
Figure 15:
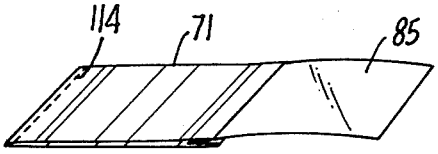
FIGS. 13 through 17 illustrate successive steps in the preparation of the device for use, in use, and following use, with the device assembled after the record has been made.
Figure 13:
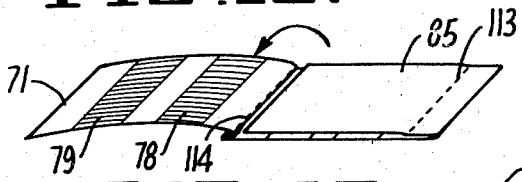
Figure 16:
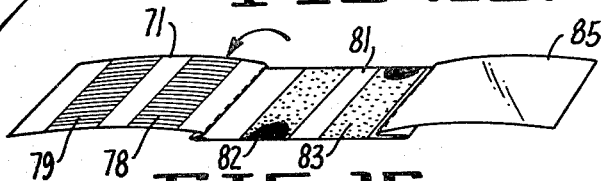
Figure 14:
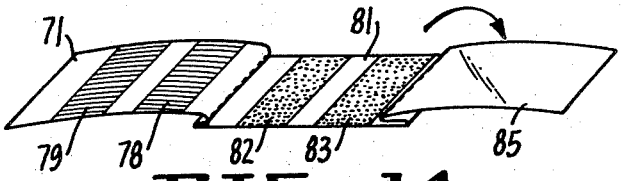
Figure 17:
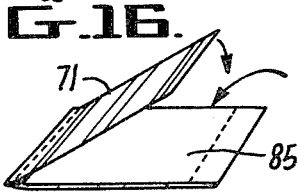
Figure 18:
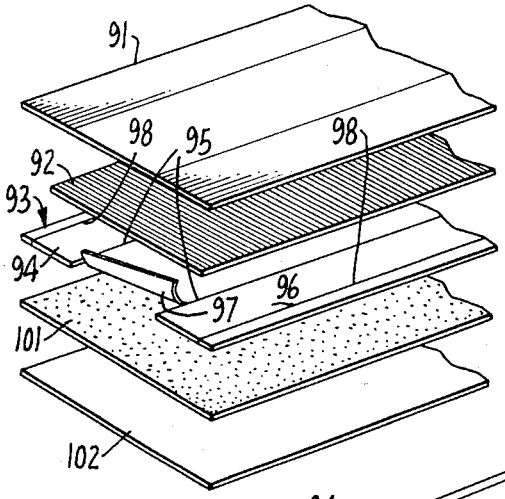
FIG. 18 is a perspective view in exploded form showing still another form of the device, several elements of the device being separated one from the other for illustrative purposes.
Figure 19:
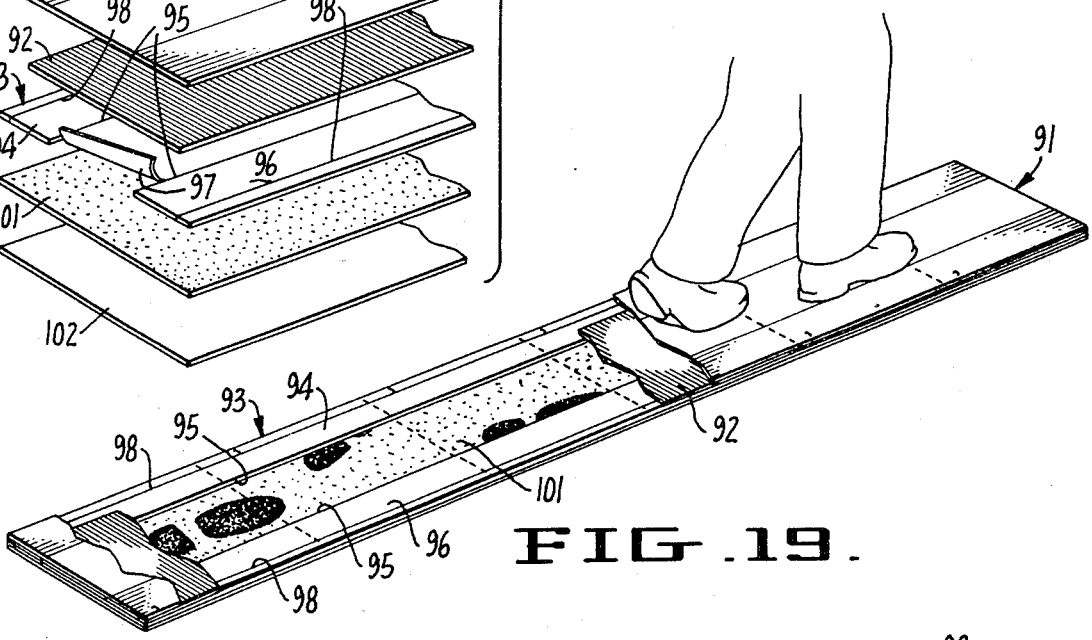
FIG. 19 shows the device of FIG. 18 in use.
Figure 20:
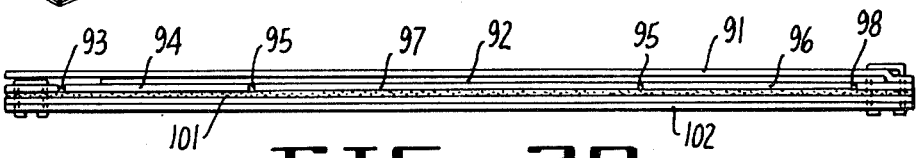
FIG. 20 is an end view of the device in assembled form.
Figure 21:
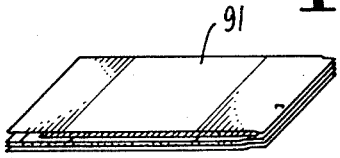
FIGS. 21 through 26 show different manipulative steps in the preparation of the device for use in recording footprints and, following such use, reassembled.
Figure 24:
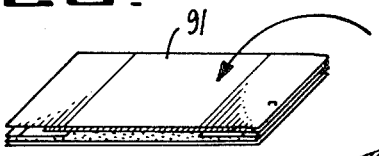
Figure 22:
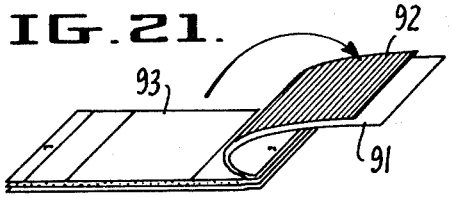
Figure 25:
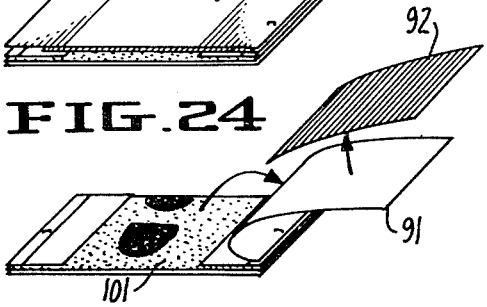
Figure 23:
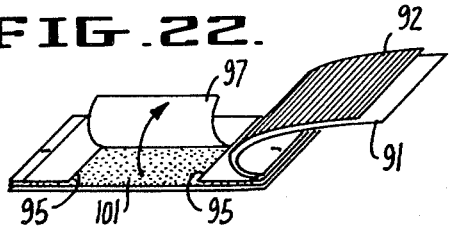
Figure 26:
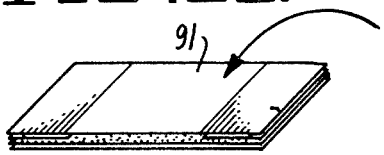

At opposite ends of several interconnected lengths of the described sheets, I provide adhesive strips 86 and 87 which enable one to secure the assembly in position on a flat surface such as a wood or tile floor. To prepare the unit for use, the adhesive strips 86 and 87 are affixed to the floor surface. Then the top sheet 71 is folded back, as appears in FIG. 13, on scoreline 114. Sheet 85 is then moved from its interfolded position by release from scoreline 115 to one side of the assembly (FIG. 14) along scoreline 88. The top sheet 71 is then placed over the bottom sheet 81 (FIG. 15). In this position, the carbon strips 78 and 79 are over the adhesive coated areas 82 and 83. The individual then traverses the tracks between colored strips 74, 76 and 77, as shown in FIG. 10. When traverse of the strips has been completed by the individual walking with one foot in each wide band 111 and 112, the individual's footprints will be transferred by the carbon to the adhesive surfaces 82 and 83. When this has been completed, the protective sheet 85 is then returned to position over the adhesive strips 82 and 83 upon which the transfer from the carbon strips has been completed (FIG. 17). Thus, one is provided with a complete record of the traverse of the individual's feet over the extended strips. Thus, the successive steps in the use of the device can be summarized as follows:

1. Fold back top sheet 71 on scoreline 114.
2. Lift protective sheet 85 along scoreline 88 and fold back on perforation 88 to expose adhesive strips 82 and 83.
3. Replace top sheet 71 over adhesive.
4. Remove tape liner from the adhesive strips 86 and 87 to each end of walking progress recorder and affix to smooth hard floor surface.
5. Indicate direction of patient travel with a small arrow.
6. Have the subject walk with one foot in each white track.
7. Replace protective sheet 85 and return top sheet 71 to original position. Fold strips 86 and 87 to prevent adhesive grab.
8. Place in an envelope for record purposes.

The foregoing may be repeated every three to five days to record the recovery progress of the person.

In the form of the device shown in FIGS. 18 through 26, an upper sheet 91 is provided as the uppermost sheet in the assembly. Positioned immediately beneath the upper sheet is a layer of carbon paper 92 which overlies a protective sheet 93. The opposite side portions of the sheet 93, indicated at 94 and 96, are preferably colored to leave an intermediate strip 97 of a white color. Immediately beneath sheet 93 is another sheet 101 which is coated with an adhesive and a lower cover sheet 102. The several sheets are secured along one of the longitudinal marginal edges. Sheet 93 is preferably weakened along lines 95 to permit ready removal of strip 97. In some instances, the sheet 93 is also weakened by slits 98 closely adjacent each longitudinal edge. Thus, it is possible to remove selectively the intermediate strip 97 of sheet 93 or to remove all of that portion of the protective sheet 93 between slits 98 on opposite sides of sheet 93. Thus, one is able to provide either a relatively narrow record portion of the width of the intermediate strip 97 or a wider record portion defined by the slits 98.

In use, strip 97 is removed to expose the corresponding area on lower strip 101. When the carbon paper strip 92 is in contact with strip 101, the footprints made by an individual walking the length of the sheet 91 will appear upon the lower strip 101. Upon completion of the test, the carbon paper strip 92 is removed to provide a permanent record of the tracks of the individual traversing the uppermost strip 91. The successive steps thus indicated are as follows:

1. Lift the top sheet 91, remove and discard the protective strip 97 from the center of sheet 93 to expose the adhesive strip 101 allowing the carbon to contact the adhesive.
2. The individual being tested walks heel to toe along the white line on sheet 91.
3. Any step on the white line will transfer prints to sheet 101.
4. After test, tear out carbon 92.
5. Refold test and return to its envelope.
6. If desirable, affix test device to floor or join tests together for longer track, using tape at each end of test device.

I claim:

1. A method for recording a person's ability to walk in a predetermined area comprising the steps of:

providing a bottom sheet with at least one record area and marginal portions on either side of the record area;

placing adhesive means on said bottom sheet only in said record area and maintaining said marginal areas free of adhesive;

placing a cover sheet over said bottom sheet;

placing at least one strip of transfer means on the underside of said cover sheet;

defining a test area on said cover sheet between the marginal edges of said cover sheet so that said test area is coincident only with said bottom sheet adhesive means and said record area;

walking on said test area by a person undergoing a test;

forming prints on said record area only of that portion of a person's foot which contacts said test area and forming a record of a person's path as such person traverses said test area.

2. The method defined in claim 1 further including steps of: positioning a transfer preventing sheet between said cover sheet and said bottom sheet, preventing transfer of imprints to said record area from said test area, and removing said transfer preventing sheet prior to the step wherein a person undergoing a test walks on said test area.

3. The method defined in claim 2 further including a step of reinserting said transfer preventing sheet between said cover sheet and said bottom sheet after the step of forming a record of a person's path as such person traverses said test area.

4. The method of claim 1 further including folding said test area for storage thereof prior to use.

* * * * *